US007987805B1

(12) United States Patent
Buescher et al.

(10) Patent No.: US 7,987,805 B1
(45) Date of Patent: Aug. 2, 2011

(54) NEUTRALLY BUOYANT SUBMERGED SYSTEM USING LESSER DENSITY BALLAST FLUID

(75) Inventors: James Buescher, San Diego, CA (US); Peter Sullivan, Solana Beach, CA (US); Aaron Bratten, El Cajon, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 181 days.

(21) Appl. No.: 12/473,485

(22) Filed: May 28, 2009

(51) Int. Cl.
*B63G 8/14* (2006.01)

(52) U.S. Cl. ..... 114/330; 114/121

(58) Field of Classification Search ..... 114/121, 114/125, 330, 333
See application file for complete search history.

(56) References Cited

U.S. PATENT DOCUMENTS 2,887,977 A * 5/1959 Piry ..... 114/333
3,343,511 A * 9/1967 Hinton et al. ..... 114/330
3,379,156 A 4/1968 Keays
3,437,065 A * 4/1969 Robbins, Jr. ..... 114/330
4,448,145 A 5/1984 Hervieu
5,309,857 A * 5/1994 Brosseuk ..... 114/125

* cited by examiner

*Primary Examiner* — Lars A Olson

(74) *Attorney, Agent, or Firm* — Kyle Eppele; Stephen E. Baldwin

(57) ABSTRACT

The invention provides a means by which the attitude or orientation of a submerged object can be changed or altered using a fixed quantity of transferable ballast fluid which has a density less than that of the surrounding fluid in which the object is submerged. In one embodiment, the process utilizes a static negatively buoyant material (which could be a lead weight) to offset the net negative buoyancy of the transferable ballast fluid. In this way, the total overall buoyancy of the system does not change, but by transferring ballast fluid into expandable reservoirs which are physically separated from the static negatively buoyant material, the separation between the center of buoyancy and the center of mass of the object can be changed, and thus the attitude or orientation of the object, if it is unrestrained, may be changed.

7 Claims, 4 Drawing Sheets

NEUTRALLY BUOYANT SUBMERGED SYSTEM USING LESSER DENSITY BALLAST FLUID

FEDERALLY-SPONSORED RESEARCH AND DEVELOPMENT

This invention (Navy Case No 99597) is assigned to the United States Government and is available for licensing for commercial purposes. Licensing and technical inquiries may be directed to the Office of Research and Technical Applications, Space and Naval Warfare Systems Center, Pacific, Code 72120, San Diego, Calif., 92152; voice (619) 553-2778; email T2@spawar.navy.mil.

CROSS-REFERENCE TO RELATED APPLICATIONS

This application is related to pending patent application Ser. No. 12/469,827, filed May 21, 2009, entitled NEUTRALLY BUOYANT SUBMERGED SYSTEM USING GREATER DENSITY BALLAST FLUID (NC 99596), assigned to the same assignee as the present application, and the details of which are hereby incorporated by reference.

BACKGROUND OF THE INVENTION

Previous methods for modifying the attitude of submerged objects have involved (a) the shifting of non-fluid mass within the submerged object to alter the position of the center of mass, or by (b) dynamic lifting surfaces or thrusters which require relative velocity of the submerging fluid to exert external forces on the object and change its attitude. Alternatively (c) inflatable or floodable volumes may be used to displace or ingest quantities of submerging fluid from a submerged object, thus changing the object's total volume, center of buoyancy, and attitude.

Of the above described previous methods, (a) is impractical for very large or non-rigid submerged objects because of the practical issues of re-positioning non-fluid mass within the object. Further, objects which are not large enough to internally house repositionable masses are limited by that approach. Method (b) is impractical for objects which are or must remain static in the submerged fluid, which is to say those which are not moving or cannot move, and method (c) is impractical for systems which cannot afford an overall change in net buoyancy in order to achieve attitude modification.

SUMMARY

The system provides an apparatus for changing the attitude of a submerged object immersed within a surrounding fluid. The system includes a first expandable reservoir collocated with a fixed, negatively buoyant mass and a second, separate expandable reservoir. A flexible fluid conduit transfers a ballast fluid between the first and second reservoirs, where the reservoirs and conduit contain a fixed volume of the ballast fluid, which is lesser in density than the surrounding fluid. The object has a passively stable orientation and has an initial center of mass and buoyancy and a net neutral buoyancy. A pump mechanism controls the transfer of the ballast fluid between the reservoirs via the fluid conduit to provide another passively stable attitude of the object with a new center of mass and buoyancy but with an unchanged net neutral buoyancy, thereby controllably changing the attitude of the immersed object.

BRIEF DESCRIPTION OF THE DRAWINGS

Throughout the several views, like elements are referenced using like references.

DETAILED DESCRIPTION OF THE EMBODIMENTS

The invention provides a means by which the attitude or orientation of a submerged object can be changed or altered using a fixed quantity of transferable ballast fluid which has a density less than that of the surrounding fluid in which the object is submerged. In one embodiment, the process utilizes a static negatively buoyant material (which could be a lead weight) to offset the net positive buoyancy of the transferable ballast fluid. In this way, the total overall buoyancy of the system does not change, but by transferring ballast fluid into expandable reservoirs which are physically separated from the static negatively buoyant material, the separation between the center of buoyancy and the center of mass of the object can be changed, and thus the attitude or orientation of the object, if it is unrestrained, may be changed.

Figure 1:
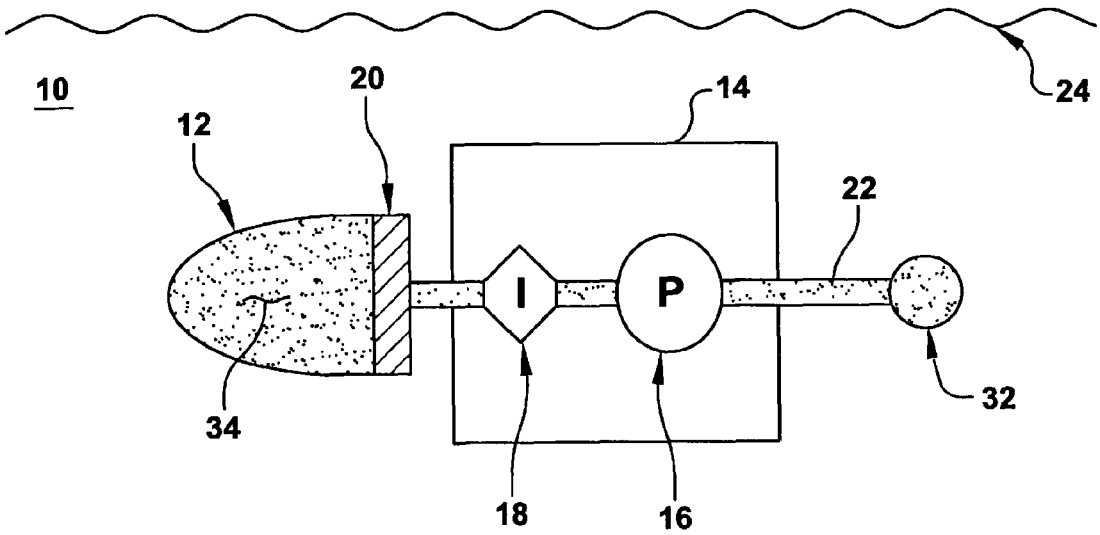
FIG. 1 shows a side view of one attitude or orientation of the present system.

In FIG. 1, an underwater object 10 includes a first expandable reservoir 12 collocated with a fixed negatively buoyant mass 20. A fluid conduit 22 runs from the reservoir 12 through a valve 18 to a pump mechanism 16 capable of transferring ballast fluid 34. Pump 16 expels ballast fluid 34 into a second, separate expandable reservoir 32 via flexible interconnecting conduit 22. Reservoirs 12, 32 and conduit 22 are filled with a fixed volume of ballast fluid 34, which is lesser in density than the surrounding fluid 24. The entire object 10 is immersed in the surrounding fluid 24, which in this instance is water. The ballast fluid 34 could be an oil-based fluid which is lesser in density than water.

Pump 16 and valve 18 can be contained within a control unit 14, for purposes of providing a remote control capability of controllably transferring ballast fluid 34 between the reservoirs 12 and 32.

Reservoirs 12, 32 are typically an elastomeric (rubber) type material which can be suitably expanded. One type of reservoir which could be utilized with the system 10 of FIG. 1 is an elastomeric rolling diaphragm from Bellofram Corporation. The flexible conduit 22 could be a flexible polyurethane hose, known as Tygon tubing.

In one configuration, shown by FIG. 1, the reservoir 32 contains enough fluid 34 to exactly offset the static negative buoyancy of the mass 20. The object 10 is assumed to be neutrally buoyant and passively stable in this orientation.

Figure 2:
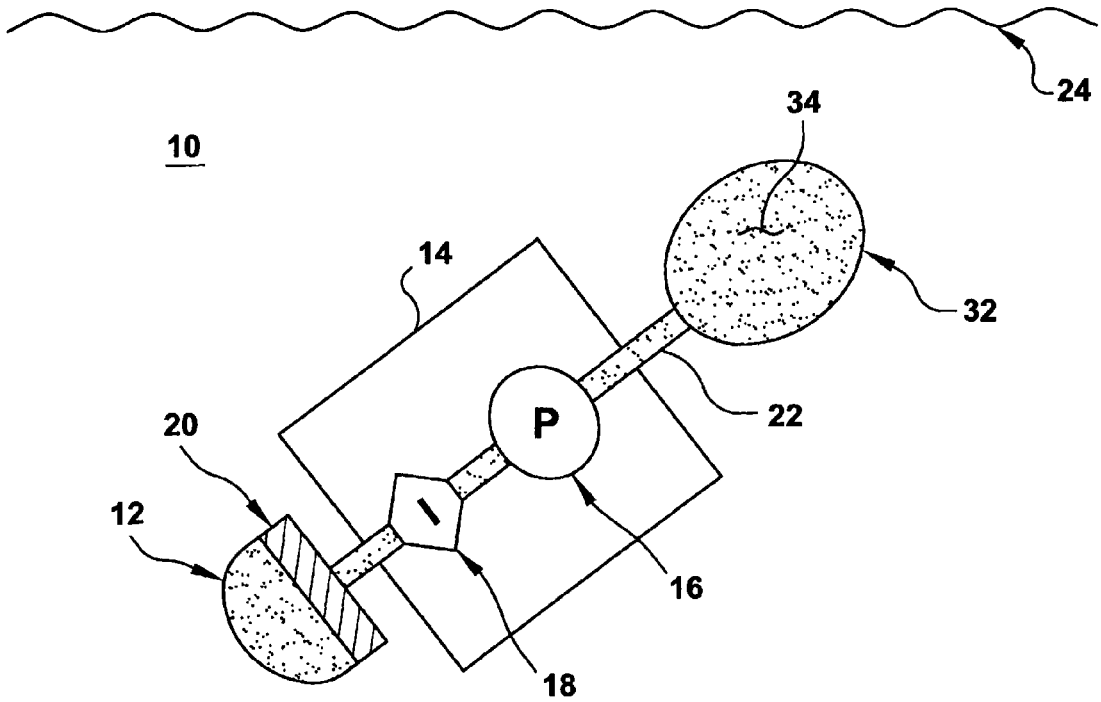
FIG. 2 shows another side view of the present system in which the attitude or orientation is changing.

FIG. 2 shows the system 10 when it is in the process of changing attitude. The gate valve 18 has been opened, and the pump 16 has transferred a quantity of ballast fluid 34 to the expandable reservoir 32 which is not collocated with the offsetting mass 22. It should be understood that the control unit 16, containing the pump mechanism 16 and valve 18, could be remotely controlled, to provide a remotely controlled gated pump valve mechanism.

Figure 3:
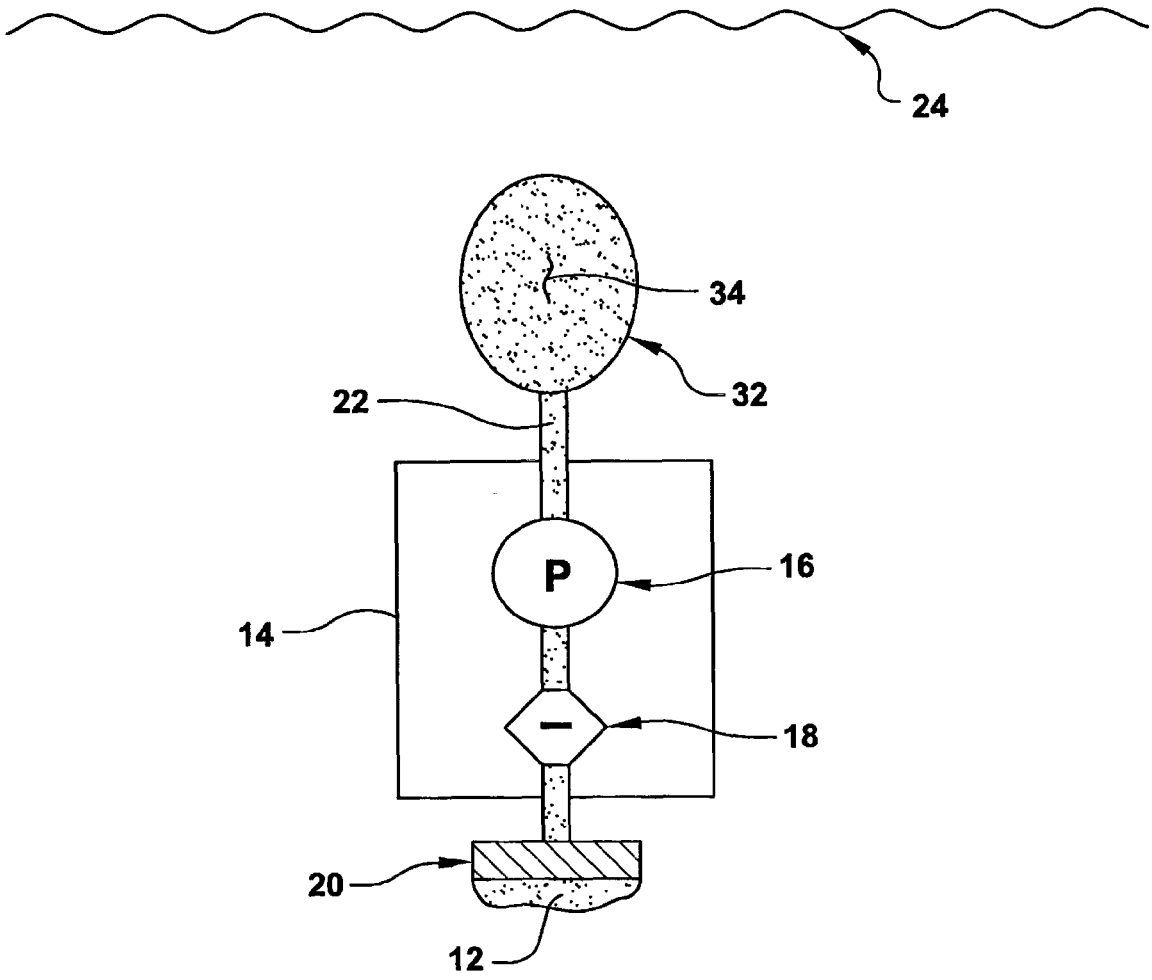
FIG. 3 shows another side view of the present system in which the attitude or orientation has changed.

FIG. 3 shows the system 10 after attitude has changed. The gate valve 18 is now closed, and the static negatively buoyant element 20 has sunk downward in the surrounding fluid 24 while the reservoir 32 of lesser density ballast fluid 34 has floated upward, as shown in FIG. 3, to achieve alignment of the new center of buoyancy of object 10 with the new center of mass of object 10. The object 10 is now passively stable in this orientation, and the total net buoyancy of the object 10 is unchanged from FIG. 1.

The process can be reversed, and by pumping all of the transfer fluid 34 back into reservoir 32, the attitude of the object can be reverted to that shown in FIG. 1.

Figure 4:
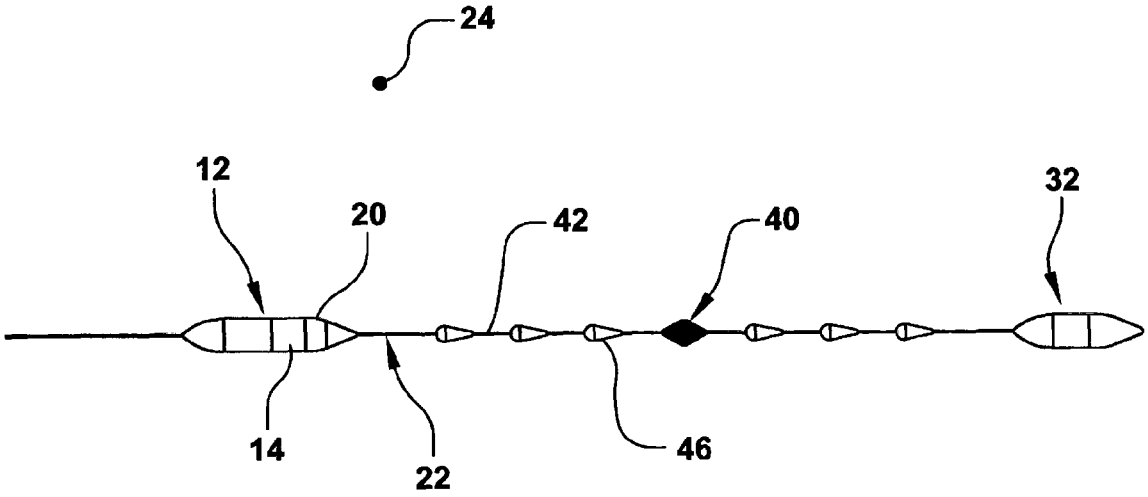
FIGS. 4 and 5 show the basic components of a non-rigid array of the present system which is submerged in water.
Figure 5:
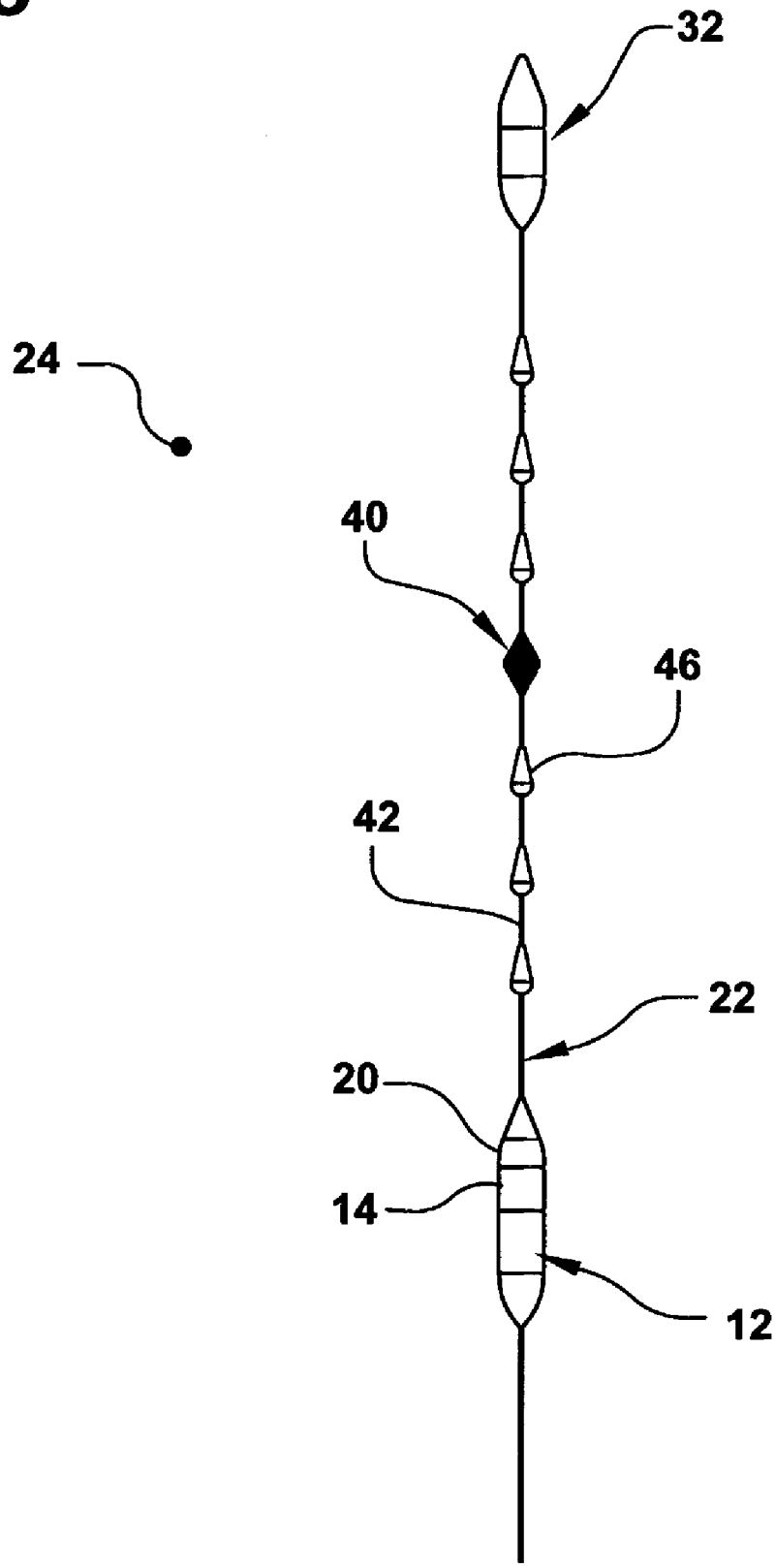

In one embodiment, the system 10 is can change the attitude of an object, such as an array of sensor elements shown in FIGS. 4-5. The array of sensor elements shown in FIGS. 4-5 is normally submerged in water and intended to have two separate attitudes which may be selected by changing or modifying the attitude of the object through the transfer of a ballast fluid, as previously described. These configurations approximate a horizontal (or level) attitude, as shown in FIG. 4, and a vertical (or upright) attitude as shown in FIG. 5.

FIGS. 4 and 5 show the basic components of a non-rigid array system 10 which is submerged in water 24. The array system 10 includes a flexible conduit cable 22 which is connected between reservoir 12, including negative buoyant element 20, and reservoir 32. The transfer of a ballast fluid between reservoir 12 and reservoir 32 is controlled by pump mechanism 14, as previously described An arbitrary number of sensor elements 40 may be located on the array 10 to collect and transmit information via separate cable 42, as well as an arbitrary number of flotation elements 46. The system 10 can be applied to sensor arrays such as a DADS (Deployable Autonomous Distributed System) array, as well as other objects, such as a rigid beam or the hull of a submarine, as examples.

The method described by this invention has the advantage of working for rigid as well as non-rigid submerged bodies, so long as the expandable reservoirs can be connected by flexible conduit. System 10 transfers lesser density fluids to change the center of mass, center of buoyancy, and attitude of submerged objects. The system 10 works to change attitude of a submerged object even when the object is completely static in the submerging fluid. The invention can be applied externally to pre-existing submerged objects which may be of small or unusual shape, or unsuitable for internal modification. The invention does not cause any net negative or positive gain in total buoyancy.

From the above description of the Neutrally Buoyant Submerged System Using Lesser Density Ballast Fluid, it is apparent that various techniques may be used for implementing the concepts of system 10 without departing from its scope. The described embodiments are to be considered in all respects as illustrative and not restrictive. It should also be understood that system 10 is not limited to the particular embodiments described herein, but is capable of many embodiments without departing from the scope of the claims.

What is claimed is:

1. Apparatus for changing the attitude of a submerged object immersed within a surrounding fluid comprising a first expandable reservoir collocated with a fixed, negatively buoyant mass, a second, separate expandable reservoir, a flexible fluid conduit for transferring a ballast fluid between the first and second reservoirs, the reservoirs and conduit buoyantly supported by the surrounding fluid and containing only a fixed volume of the ballast fluid which is lesser in density than the surrounding fluid, the object having a passively stable orientation and having an initial center of mass and buoyancy and a net neutral buoyancy, a controllable pump mechanism for controllably transferring the ballast fluid between the reservoirs via the fluid conduit to provide another passively stable attitude of the object with a new center of mass and buoyancy but with an unchanged net neutral buoyancy, thereby controllably changing the attitude of the immersed object.

2. The apparatus of claim 1 wherein the pump mechanism is remotely controlled.

3. The apparatus of claim 1 wherein the object is rigid.

4. The apparatus of claim 1 wherein the object is resilient.

5. The apparatus of claim 1 wherein the surrounding fluid is water.

6. Apparatus for changing the attitude of an object immersed in a surrounding fluid comprising a first expandable reservoir collocated with a fixed, negatively buoyant element a second, separate expandable reservoir, the second expandable reservoir to provide initial static flotation of the object having a first center of mass and buoyancy and net neutral buoyancy, a remotely controllable gated valve pump mechanism for controlling fluid transfers between the first and second reservoirs via a flexible conduit, the first and second reservoirs and the flexible conduit buoyantly supported by the surrounding fluid and containing only a fixed amount of ballast fluid which is lesser in density than the surrounding fluid, where the first reservoir contains a sufficient amount of the ballast fluid to offset the static negative buoyancy of the collocated element so that the object is neutrally buoyant and passively stable, the gated valve pump mechanism controllably transferring the ballast fluid from the first reservoir to the second reservoir via the flexible conduit such that the static negative buoyant element sinks downward in the surrounding fluid while the second reservoir floats upward in the surrounding fluid to achieve alignment with a modified center of mass and buoyancy of the object to provide a passively stable orientation of the object with an unchanged net neutral buoyancy, thereby controllably changing the attitude of the immersed object.

7. Apparatus for changing the attitude of a submerged object immersed within a surrounding fluid comprising a first expandable reservoir collocated with a fixed, negatively buoyant mass, a second, separate expandable reservoir, a flexible fluid conduit for transferring a ballast fluid between the first and second reservoirs, the reservoirs and conduit buoyantly supported by the surrounding fluid and containing only a fixed volume of the ballast fluid which is lesser in density than the surrounding fluid, a controllable pump mechanism for controllably transferring the ballast fluid between the reservoirs via the fluid conduit to controllably change the attitude of the immersed object.

* * * * *